US010519762B2

(12) United States Patent
Peter

(10) Patent No.: US 10,519,762 B2
(45) Date of Patent: Dec. 31, 2019

(54) LATERAL SUPPORT FOR DOWNHOLE ELECTRONICS

(71) Applicant: Baker Hughes, a GE company, LLC, Houston, TX (US)

(72) Inventor: Andreas Peter, Celle (DE)

(73) Assignee: Baker Hughes, a GE company, LLC, Houston, TX (US)

( * ) Notice: Subject to any disclaimer, the term of this patent is extended or adjusted under 35 U.S.C. 154(b) by 0 days.

(21) Appl. No.: 15/628,197

(22) Filed: Jun. 20, 2017

(65) Prior Publication Data

US 2019/0055832 A1 Feb. 21, 2019

(51) Int. Cl.

| | |
|---|---|
| ***E21B 47/01*** | (2012.01) |
| *E21B 49/08* | (2006.01) |
| *E21B 49/00* | (2006.01) |

(52) U.S. Cl.

CPC ..... *E21B 47/011* (2013.01); *E21B 49/00* (2013.01); *E21B 49/08* (2013.01)

(58) Field of Classification Search

CPC ..... E21B 47/011; E21B 17/1014

See application file for complete search history.

(56) References Cited

U.S. PATENT DOCUMENTS 2,650,067 A * 8/1953 Martin ..... E21B 17/003 175/50
3,995,479 A * 12/1976 Chapman, III ..... E21B 17/1042 73/152.47
4,246,765 A 1/1981 Zabcik
4,326,409 A * 4/1982 Hughes ..... E02D 1/022 73/84
4,466,496 A 8/1984 Jones
4,524,324 A 6/1985 Dickinson, III (Continued)

FOREIGN PATENT DOCUMENTS

WO 2014094163 A1 6/2014
WO 2016043741 A1 3/2016

(Continued)

OTHER PUBLICATIONS

PCT Application No. PCT/US2018/038576—International Search Report dated Sep. 17, 2018.

*Primary Examiner* — Shane Bomar

(74) *Attorney, Agent, or Firm* — Mossman, Kumar & Tyler, P.C.

(57) ABSTRACT

Apparatus include a downhole tool comprising an outer member; and a probe body positioned inside the outer member; an electronics carrier positioned inside the probe body; and a lateral support system, including members cooperating to maintain a relative position of the electronics carrier with respect to the probe body, and a biasing member. The plurality of members may include an outer support ring having an axial passage therethrough for receiving the electronics carrier, the outer support ring having an inner surface; and an inner support ring within the probe body having an axial passage therethrough for receiving the electronics carrier, the inner support ring having an outer surface. The biasing member may be configured to urge a member of the plurality of members against an inner surface of the probe body by urging the outer surface of the inner support ring against the inner surface of the outer support ring.

15 Claims, 7 Drawing Sheets

(56) References Cited

U.S. PATENT DOCUMENTS

| | | | | | |
|---|---|---|---|---|---|
| 4,537,067 | A * | 8/1985 | Sharp | E21B 47/022 | 374/136 |
| 4,550,599 | A * | 11/1985 | Bridge | E21B 47/011 | 73/152.02 |
| 4,630,809 | A | 12/1986 | Duckworth | | |
| 4,715,128 | A * | 12/1987 | Cummings | E21B 7/061 | 33/1 H |
| 4,779,852 | A | 10/1988 | Wassell | | |
| 4,910,877 | A * | 3/1990 | Sokol | G01B 7/281 | 33/544 |
| 6,068,821 | A | 5/2000 | VanDeGraaf | | |
| 7,939,937 | B2 | 5/2011 | Holzmann et al. | | |
| 8,205,691 | B2 | 6/2012 | Bowar et al. | | |
| 9,850,751 | B2 * | 12/2017 | Logan | E21B 47/011 | |
| 2015/0285062 | A1 | 10/2015 | Logan et al. | | |
| 2015/0322731 | A1 | 11/2015 | Logan et al. | | |
| 2016/0032710 | A1 * | 2/2016 | Hu | E21B 47/08 | 33/544.2 |
| 2017/0044845 | A1 | 2/2017 | Deere et al. | | |

FOREIGN PATENT DOCUMENTS

| | | | |
|---|---|---|---|
| WO | 2016060683 | A1 | 4/2016 |
| WO | 02016108853 | A1 | 7/2016 |

* cited by examiner

LATERAL SUPPORT FOR DOWNHOLE ELECTRONICS

FIELD OF THE DISCLOSURE

In one aspect, this disclosure relates generally to borehole tools, and in particular to tools used for drilling a borehole in an earth formation.

BACKGROUND OF THE DISCLOSURE

Drilling wells for various purposes is well-known. Such wells may be drilled for geothermal purposes, to produce hydrocarbons (e.g., oil and gas), to produce water, and so on. Well depth may range from a few thousand feet to 25,000 feet or more. Downhole tools, used during and after drilling, often incorporate various sensors, instruments and control devices in order to carry out any number of downhole operations. Thus, the tools may include sensors and/or electronics for formation evaluation, fluid analysis, monitoring and controlling the tool itself, and so on. Tools typically include one or more printed circuit boards having electrical components attached.

SUMMARY OF THE DISCLOSURE

In aspects, the present disclosure is related to methods and apparatuses for use downhole in subterranean wellbores (boreholes), and, more particularly, in downhole drilling. Apparatus embodiments may include a downhole tool comprising an outer member configured for conveyance in the borehole, and a probe body positioned inside the outer member. The apparatus may include an electronics carrier positioned inside the probe body; and a lateral support system. The lateral support system may include a plurality of members cooperating to maintain a relative position of the electronics carrier with respect to the probe body, and a biasing member. The plurality of members may include an outer support ring within the probe body having an axial passage therethrough for receiving a portion of the electronics carrier, the outer support ring having an inner surface; and an inner support ring within the probe body having an axial passage therethrough for receiving a second portion of the electronics carrier, the inner support ring having an outer surface. The biasing member may be configured to urge a member of the plurality of members against an inner surface of the probe body by urging the outer surface of the inner support ring against the inner surface of the outer support ring, thereby maintaining separation of the probe body and the electronics carrier.

The outer surface of the inner support ring may comprise a frustoconical section. The inner surface may include an angled seat for receiving the inner support ring such that the outer support ring deforms upon receiving the inner support ring at the seat. The member urged against the inner surface of the probe body may be the outer support ring. At least one of the outer support ring and the inner support ring may be made up of a polyaryletherketone material. At least one of the inner support ring and the outer support ring may include at least one slot.

The apparatus may include a constraint restricting axial movement of the outer support ring with respect to the electronics carrier without restricting the axial movement of the outer support ring with respect to the pressure barrel. The constraint may comprise at least one of: i) an upset on the outer support ring configured to engage a groove in an outer surface of the electronics carrier, and ii) a band on the outer surface of the electronics carrier configured to engage a groove in the outer support ring.

The biasing member may be made of metal, which may be non-magnetic. The biasing member may be confined to an annular space defined by the probe body and the electronics carrier by a shoulder. The shoulder may comprise a circumferential dovetail on the electronics carrier. The apparatus may include a constraint restricting axial movement of the inner support ring with respect to the electronics carrier. This constraint may comprise an upset on the inner support ring configured to engage a groove in an outer surface of the electronics carrier, wherein the groove is defined by a ledge comprising a circumferential dovetail. The probe body may comprise a pressure barrel.

Examples of some features of the disclosure may be summarized rather broadly herein in order that the detailed description thereof that follows may be better understood and in order that the contributions they represent to the art may be appreciated.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION

Figure 1:
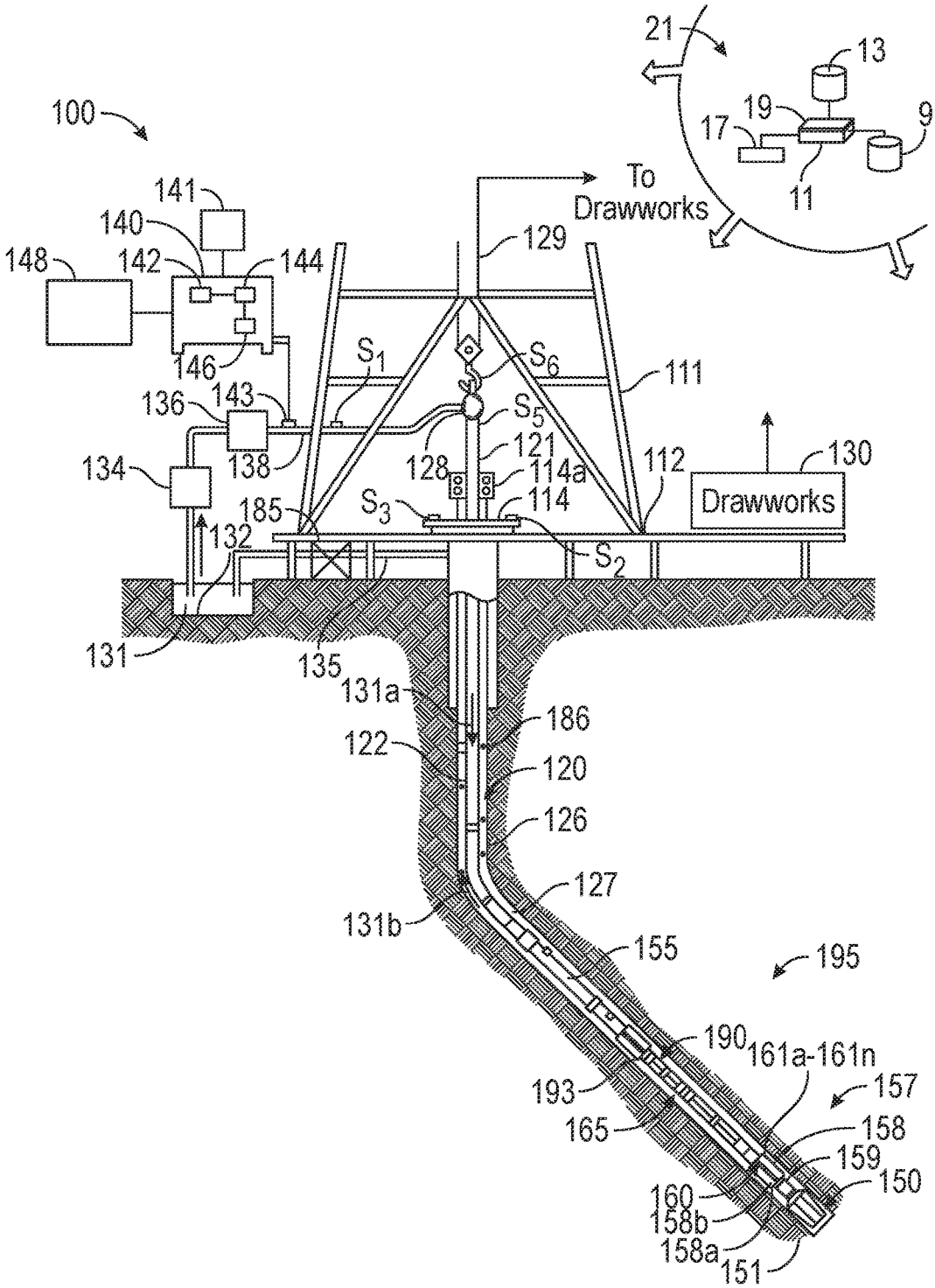
FIG. 1 shows a schematic diagram of an example drilling system in accordance with embodiments of the present disclosure for evaluating a condition of a component of a drillstring.

Aspects of the present disclosure relate to improvements in supports for housings for electronic components used downhole (e.g., in subterranean boreholes intersecting the formation), such as multi-chip modules (MCMs), printed circuit boards, and other electronics. Aspects include apparatuses for drilling boreholes and for downhole logging including one or more tools including a housing or other outer member adapted for the rigors of such applications. In aspects, the present disclosure includes apparatuses related to drilling a borehole in an earth formation, performing well logging in a borehole intersecting an earth formation, and so on.

Such tools contain printed circuit boards and other delicate electronics, usually mounted on some sort of an electronics carrier, or frame. Traditional printed circuit boards have been around for many decades. A printed circuit board (PCB) is a plate or board comprising a substrate supporting different elements that make up delicate electronic circuits that contain the electrical interconnections between them. The substrate is typically made from epoxy resin. In order to protect the electronics from the surrounding fluid, the electronics carrier is often mounted inside a body located within the housing such as a pressure barrel of a drilling system, other probe body, etc.

Measurement-while-drilling and logging-while-drilling (MWD/LWD) tools experience demanding conditions, including elevated levels of vibration, shock, and heat. Vibration and shock experienced by the components of a MWD/LWD tool may reach levels of greater than 50 gravitational units (gn), and in some cases more than 750 gravitational units. Severe downhole vibrations can damage drilling equipment including the drill bit, drill collars, stabilizers, MWD/LWD, and Rotary Steerable System (RSS). Further, MWD/LWD tools continue to be exposed to ever hotter environments.

Lateral supports are conventionally incorporated to prevent contact between the electronics carrier and an inner surface of the probe body despite the tool being subjected to lateral accelerations, e.g., during drilling operations. Lateral, as used herein, refers to orientation in a non-axial direction—that is, away from the longitudinal axis of the tool. A typical support in the industry is an elastomeric ring, which may be located in a circumferential groove in the outer diameter of the electronics carrier. While the support from such rings may be sufficient for lightweight carriers and limited amounts of acceleration, it fails in the case of heavier electronics carriers, or stronger accelerations, such as, for example, shocks resulting from impacts to the outer surface of the drill collar. Moreover, high temperature electronics (e.g., multi-chip modules (MCMs)) in titanium housings may be heavier than prior art PCBA electronics. Adequately laterally supporting these heavier housings can be quite problematic. Further exacerbating this issue, the stiffness of the elastomer (e.g., rubber) is also negatively impacted by high temperatures, leading to impact between the electronics carrier and the inner diameter surface of the probe at even relatively low accelerations.

Aspects of the present disclosure provide a novel way of laterally supporting electronics inside downhole drilling or logging tools. Embodiments disclosed herein may include a lateral support that is stable over a wide temperature range and prevents impacts between carrier and the inner probe surface at much higher accelerations and carrier mass than conventional systems.

Further, some embodiments may be particularly well adapted to facilitating assembly of the various components (e.g., housing, probe body, lateral supports, electronics carrier, etc.) into the final downhole tool. Aspects disclosed herein may fit within traditional radial design space specifications developed for the conventional elastomeric ring, as described in further detail below. Positioning of a carrier in accordance with embodiments of the present disclosure into a probe body may be accomplished in much the same way as conventional techniques.

Apparatus embodiments may include a downhole tool comprising an outer member configured for conveyance in the borehole; a probe body positioned inside the outer member; an electronics carrier positioned inside the probe body; and a lateral support system. The lateral support system may comprise a plurality of members cooperating to maintain a relative position of the electronics carrier with respect to the probe body. The plurality of members may comprise an outer support ring within the probe body having an axial passage therethrough for receiving a portion of the electronics carrier; an inner support ring within the probe body having an axial passage therethrough for receiving a second portion of the electronics carrier; and a biasing member. The biasing member may be configured to urge a member of the plurality of members against an inner surface of the probe body by urging the outer surface of the inner support ring against the inner surface of the outer support ring, and thereby maintaining separation of the probe body and the electronics carrier.

In aspects, urging the outer surface of the inner support ring against the inner surface of the outer support ring changes a relative radial position of at least a portion of at least one of the inner support ring and the outer support ring, causing at least one member of the plurality to apply a force against the inner surface of the probe body and at least one other member to apply a force against the outer surface of the electronics carrier. This may be achieved by deformation of at least one element.

Techniques described herein are particularly suited for use in measurement of values of properties of a formation downhole or of a downhole fluid while drilling, through the use of instruments which may utilize components as described herein, or otherwise for use in conducting operations downhole. These values may be used to evaluate and model the formation, the borehole, and/or the fluid, and for conducting further operations in the formation or the borehole.

In some implementations, the above embodiments may be used as part of a drilling system. FIG. 1 shows a schematic diagram of an example drilling system in accordance with embodiments of the present disclosure for evaluating a condition of a component of a drillstring. FIG. 1 shows a drillstring (drilling assembly) 120 that includes a bottomhole assembly (BHA) 190 conveyed in a borehole 126. The drilling system 100 includes a conventional derrick 111 erected on a platform or floor 112 which supports a rotary table 114 that is rotated by a prime mover, such as an electric motor (not shown), at a desired rotational speed. A tubing (such as jointed drill pipe 122), having the drillstring 190, attached at its bottom end extends from the surface to the bottom 151 of the borehole 126. A drillbit 150, attached to drillstring 190, disintegrates the geological formations when it is rotated to drill the borehole 126. The drillstring 120 is coupled to a drawworks 130 via a Kelly joint 121, swivel 128 and line 129 through a pulley. Drawworks 130 is operated to control the weight on bit ("WOB"). The drillstring 120 may be rotated by a top drive (not shown) instead of by the prime mover and the rotary table 114. Alternatively, a coiled-tubing may be used as the tubing 122. A tubing injector 114*a* may be used to convey the coiled-tubing having the drillstring attached to its bottom end. The operations of the drawworks 130 and the tubing injector 114*a* are known in the art and are thus not described in detail herein.

A suitable drilling fluid 131 (also referred to as the "mud") from a source 132 thereof, such as a mud pit, is circulated under pressure through the drillstring 120 by a mud pump 134. The drilling fluid 131 passes from the mud pump 134 into the drillstring 120 via a desurger 136 and the fluid line 138. The drilling fluid 131*a* from the drilling tubular discharges at the borehole bottom 151 through openings in the drillbit 150. The returning drilling fluid 131*b* circulates uphole through the annular space 127 between the drillstring 120 and the borehole 126 and returns to the mud pit 132 via a return line 135 and drill cutting screen 185 that removes the drill cuttings 186 from the returning drilling fluid 131*b*.

In some applications, the drillbit 150 is rotated by only rotating the drill pipe 122. However, in many other applications, a downhole motor 155 (mud motor) disposed in the drillstring 190 also rotates the drillbit 150. The rate of penetration (ROP) for a given BHA largely depends on the WOB or the thrust force on the drillbit 150 and its rotational speed.

The mud motor 155 is coupled to the drillbit 150 via a drive shaft disposed in a bearing assembly 157. The mud motor 155 rotates the drillbit 150 when the drilling fluid 131 passes through the mud motor 155 under pressure. The bearing assembly 157, in one aspect, supports the radial and axial forces of the drillbit 150, the down-thrust of the mud motor 155 and the reactive upward loading from the applied weight-on-bit.

A surface control unit or controller 140 receives signals from the downhole sensors and devices via a sensor 143 placed in the fluid line 138 and signals from sensors S1-S6 and other sensors used in the system 100 and processes such signals according to programmed instructions provided to the surface control unit 140. The surface control unit 140 displays desired drilling parameters and other information on a display/monitor 141 that is utilized by an operator to control the drilling operations. The surface control unit 140 may be a computer-based unit that may include a processor 142 (such as a microprocessor), a storage device 144, such as a solid-state memory, tape or hard disc, and one or more computer programs 146 in the storage device 144 that are accessible to the processor 142 for executing instructions contained in such programs. The surface control unit 140 may further communicate with a remote control unit 148. The surface control unit 140 may process data relating to the drilling operations, data from the sensors and devices on the surface, data received from downhole, and may control one or more operations of the downhole and surface devices. The data may be transmitted in analog or digital form.

The BHA 190 may also contain formation evaluation sensors or devices (also referred to as measurement-while-drilling ("MWD") or logging-while-drilling ("LWD") sensors) determining resistivity, density, porosity, permeability, acoustic properties, nuclear-magnetic resonance properties, formation pressures, properties or characteristics of the fluids downhole and other desired properties of the formation 195 surrounding the BHA 190. Such sensors are generally known in the art and for convenience are generally denoted herein by numeral 165. The BHA 190 may further include other sensors and devices 159 for determining one or more properties of the BHA 190 generally (such as vibration, acceleration, oscillations, whirl, stick-slip, etc.) and general drilling operating parameters (such as weight-on-bit, fluid flow rate, pressure, temperature, rate of penetration, azimuth, tool face, drillbit rotation, etc.) For convenience, all such sensors are denoted by numeral 159.

The BHA 190 may include a steering apparatus or tool 158 for steering the drillbit 150 along a desired drilling path. In one aspect, the steering apparatus may include a steering unit 160, having a number of force application members 161*a*-161*n*, wherein the steering unit is at partially integrated into the drilling motor. In another embodiment the steering apparatus may include a steering unit 158 having a bent sub and a first steering device 158*a* to orient the bent sub in the wellbore and the second steering device 158*b* to maintain the bent sub along a selected drilling direction.

Suitable systems for making dynamic downhole measurements include COPILOT, a downhole measurement system, manufactured by BAKER HUGHES INCORPORATED. Any or all of these sensors may be used in carrying out the methods of the present disclosure.

The drilling system 100 can include one or more downhole processors at a suitable location such as 193 on the BHA 190. The processor(s) can be a microprocessor that uses a computer program implemented on a suitable non-transitory computer-readable medium that enables the processor to perform the control and processing. Other equipment such as power and data buses, power supplies, and the like will be apparent to one skilled in the art. In one embodiment, the MWD system utilizes mud pulse telemetry to communicate data from a downhole location to the surface while drilling operations take place. Other embodiments could include wired pipe telemetry, wire telemetry in coiled tubing, electro-magnetic telemetry, acoustic telemetry, and so on. The surface processor 142 can process the surface measured data, along with the data transmitted from the downhole processor, to evaluate a condition of drillstring components. While a drillstring 120 is shown as a conveyance system for sensors 165, it should be understood that embodiments of the present disclosure may be used in connection with tools conveyed via rigid (e.g. jointed tubular or coiled tubing) as well as non-rigid (e.g. wireline, slickline, e-line, etc.) conveyance systems. The drilling system 100 may include a bottomhole assembly and/or sensors and equipment for implementation of embodiments of the present disclosure.

The term "information" as used herein includes any form of information (analog, digital, EM, printed, etc.). As used herein, a processor is any information processing device that transmits, receives, manipulates, converts, calculates, modulates, transposes, carries, stores, or otherwise utilizes information. In several non-limiting aspects of the disclosure, an information processing device includes a computer that executes programmed instructions for performing various methods. These instructions may provide for equipment operation, control, data collection and analysis and other functions in addition to the functions described in this disclosure. The processor may execute instructions stored in computer memory accessible to the processor, or may employ logic implemented as field-programmable gate arrays (FPGAs'), application-specific integrated circuits (ASICs'), other combinatorial or sequential logic hardware, and so on.

The surface control unit 140 may further communicate with a remote control unit 148. The surface control unit 140 may process data relating to the drilling operations, data from the sensors and devices on the surface, and data received from downhole; and may control one or more operations of the downhole and surface devices. The data may be transmitted in analog or digital form.

Surface processor 142 or downhole processor 193 may also be configured to control steering apparatus 158, mud pump 134, drawworks 130, rotary table 114, downhole motor 155, other components of the BHA 190, or other components of the drilling system 101. Surface processor 142 or downhole processor 193 may be configured to control sensors described above and to estimate a parameter of interest according to methods described herein.

Improved Lateral Support System for Electronics Carrier

General embodiments of the present disclosure may include a tool for performing well logging in a borehole intersecting an earth formation. The tool may include a printed circuit board used in operation of the tool.

Figure 2A:
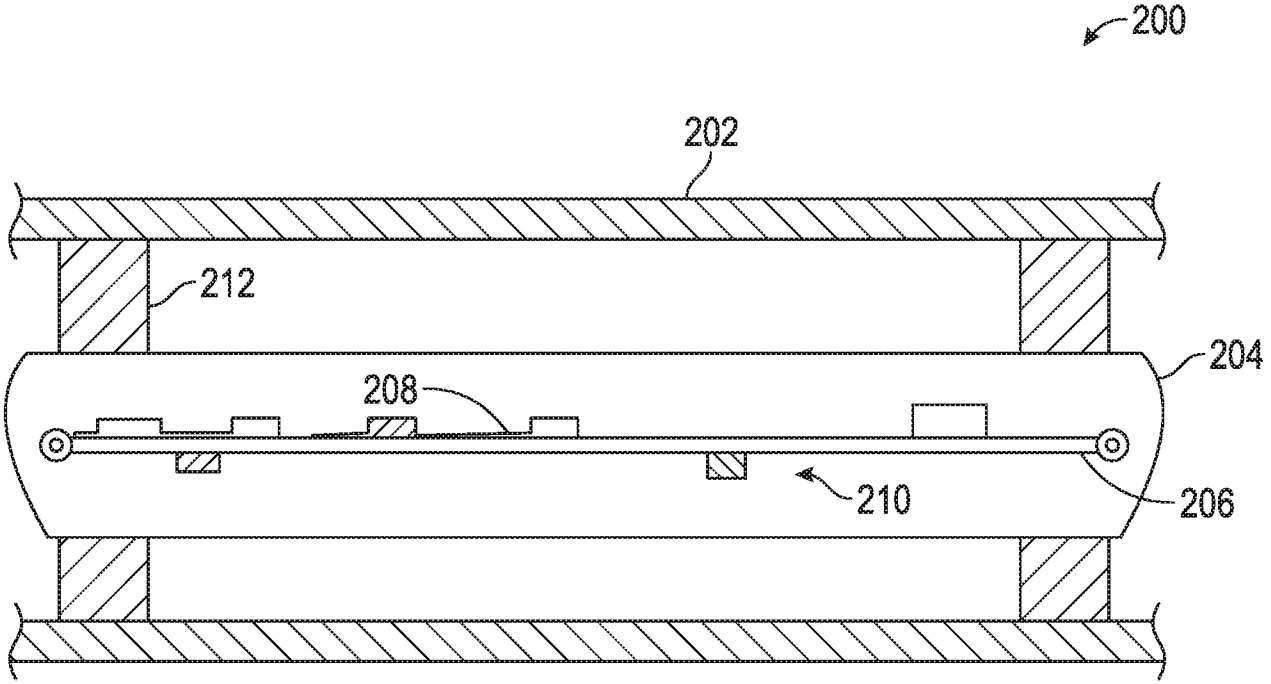
FIGS. 2A-2D illustrate devices in accordance with embodiments of the present disclosure.

FIGS. 2A-2D illustrate devices in accordance with embodiments of the present disclosure. FIG. 2A is a schematic diagram showing device 200. Device 200 includes a pressure barrel 202 configured to be positioned inside the outer member of a downhole tool. The device 200 also includes an electronics carrier 204 positioned inside the pressure barrel 202. The inner diameter of the pressure barrel may be on the order of 3.5 centimeters. The pressure barrel 202 is configured to withstand environmental pressures along the drilling depths traveled by the tool. Other types of probe bodies may be implemented, in dependence upon the specific application of device 200, including, in some cases, non-pressurized probe bodies.

Downhole electronic component(s) 210 is mounted on electronics carrier 204. In accordance with embodiments shown in FIGS. 2A & 2B, frame 206 provides a mounting surface comprised of two flat areas on which components 208 (e.g., substrates) may be disposed. Downhole electronic components 210 may include, for example, multi-chip modules, PCBs, other ICs or circuitry, and so on. Lateral support system 212 is configured to maintain separation of the electronics carrier 204 away from the pressure barrel 202. In some implementations, the electronics carrier has very little deflection, even in the presence of extreme outer loads on the pressure barrel. Lateral support system 212 is implemented as a plurality of members cooperating to maintain a relative position of the electronics carrier with respect to the probe body. The difference between the inner diameter of the pressure barrel and the outer diameter of the electronics carrier may leave a gap of less than 5 millimeters between them on each side. In many cases, this gap may only be up to 2 millimeters (e.g., 2 millimeters or less), or up to 1 millimeter.

Figure 2B:
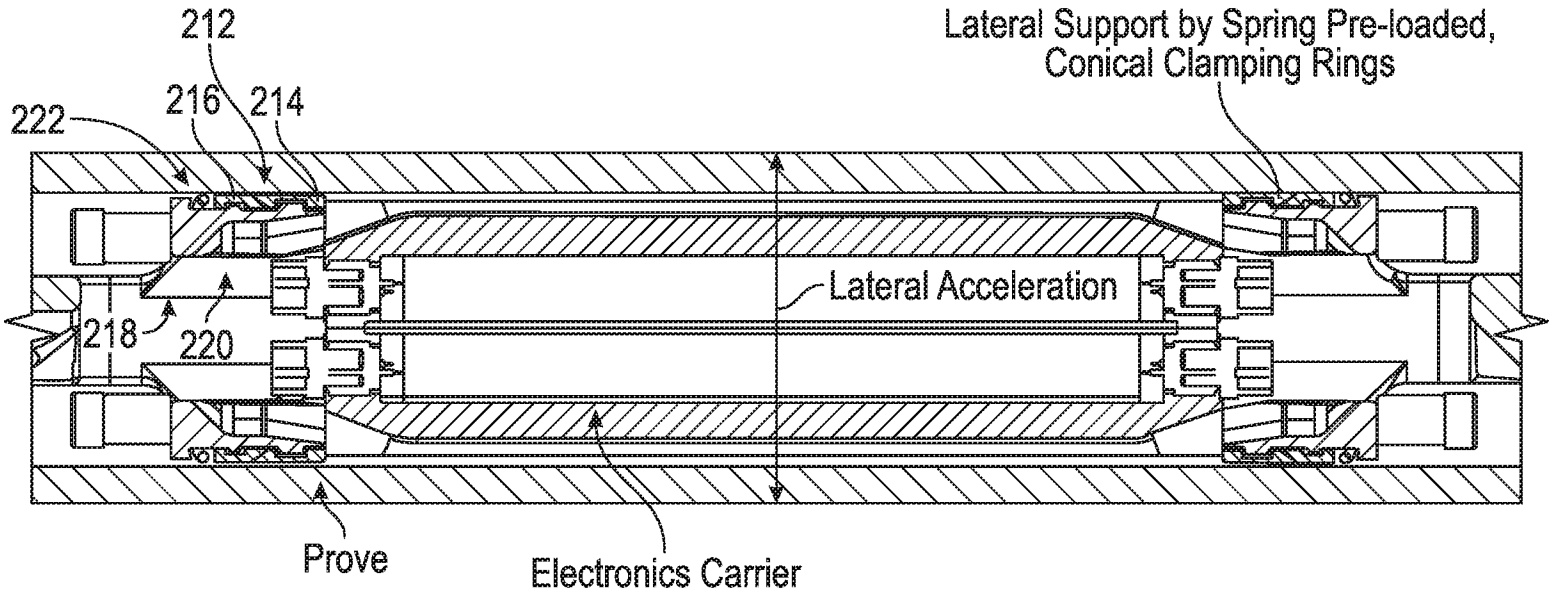

FIG. 2B shows device 200 from a cross sectional view. Referring to FIG. 2B, the members of lateral support system 212 include, at each end, an outer support ring 214 within the pressure barrel 202 having an axial passage therethrough for receiving a portion 220 of the electronics carrier 204 and an inner support ring 216 within the pressure barrel 202 having an axial passage therethrough for receiving a second portion 218 of the electronics carrier 204. Either or both of the outer support ring and the inner support ring may be made up of a polyaryletherketone material, such as, for example, a polyether ether ketone ('PEEK'), Polyetherketoneketone ('PEKK'), or the like. The outer support ring and the inner support ring may alternatively be made up of metal (e.g., aluminum, brass, copper, etc.), polyamide-imides (e.g., TORLON™ thermoplastic materials provided by SOLVAY ADVANCED POLYMERS L.L.C. of Alpharetta, Ga.), or other plastics or composites. The members may be made up of the same materials (e.g., the outer support ring and the inner support ring may both be made of PEEK) or of different materials. In particular implementations, materials having a Shore A hardness of 95 (or the equivalent) or above, or a Shore D hardness of 80 or above may be desirable. The lateral support system 212 also includes a biasing member 222.

Figure 2C:
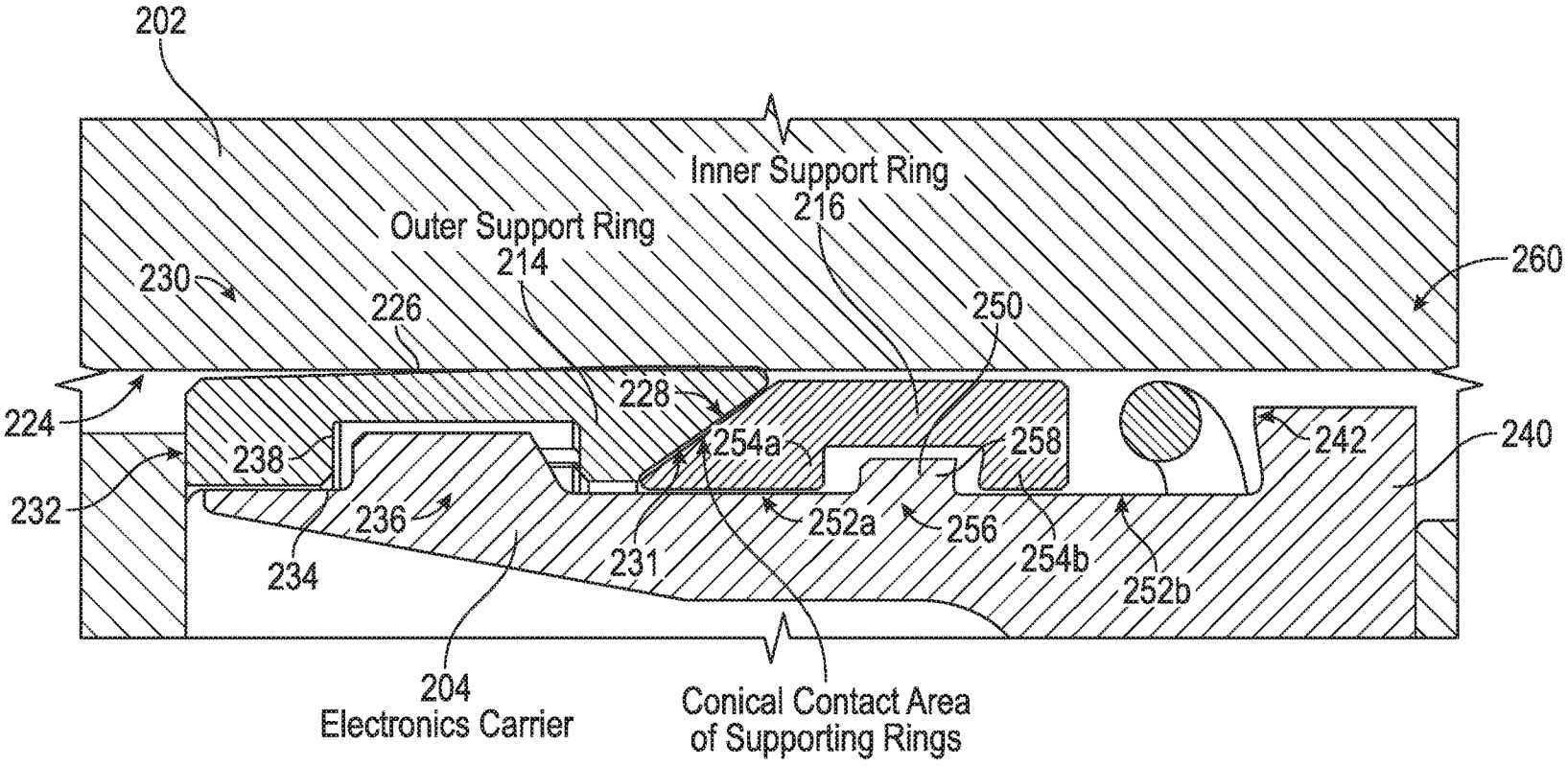

FIG. 2C shows a cross-sectional view of lateral support system 212. The biasing member 222 is configured to urge a member of the plurality of members against an inner surface 224 of the pressure barrel 202 by urging the outer surface 228 of the inner support ring 216 against the inner surface 231 of the outer support ring 214, and thereby maintaining separation of the pressure barrel 202 and the electronics carrier 204. The outer surface 228 of the inner support ring 216 may be implemented as a frustoconical section. The inner surface 231 comprises an angled seat for receiving the inner support ring 216. The angle of the angled seat is shown at approximately 35 degrees.

In operation, urging the outer surface 228 of the inner support ring 216 against the inner surface 231 of the outer support ring 214 may cause the outer support ring to deform upon receiving the inner support ring at the seat. As shown in FIG. 2C, the member urged against the inner surface 224 may be the outer support ring 214, which presses against inner surface 224 with outer surface 226.

The biasing member 222 may be a spring, such as a traditional spring, a disc spring (e.g., a multi-wave disc spring), or the wave spring depicted in FIG. 2C. The spring may be metal (e.g., steel, a nickel base alloy such as Inconel, Beryllium-Copper (CuBe2), etc.) or an alternative material. The biasing member may alternatively be implemented using an elastomeric member. The biasing member 222 may be confined to an annular space defined by the probe body and the electronics carrier by a shoulder 240 on the electronics carrier. The shoulder 240 may include a circumferential dovetail 242. The dovetail 242 may function to maintain the position of biasing member 222. For example, without shoulder 240 with circumferential dovetail 242, the spring may jump out of its groove during insertion of the electronics carrier into the pressure barrel upon the outer support ring being compressed by a lead-in chamfer on the entry of the inner surface of the pressure barrel.

The device 200 also features a constraint 230 restricting axial movement of the outer support ring 214 with respect to the electronics carrier 204 without restricting the axial movement of the outer support ring with respect to the pressure barrel 202. The constraint 230 includes an upset 232 on the outer support ring configured to engage a groove 234 in an outer surface of the electronics carrier 214 and a band 236 on the outer surface of the electronics carrier 214 configured to engage a groove 238 in the outer support ring 214. Together, the upset 232 and the groove 234 form a mechanical locking feature.

In operation, constraint 230 may enable limited axial slipping of outer support ring 214 while the outer surface 228 of the inner support ring 216 is urged against the inner surface 231 of the outer support ring 214. This slipping, along with the choice of angle of the frustoconical section of the inner support ring 216 and the angled seat of the outer support ring may be configured to ensure deformation of the outer support ring in a substantially radial direction. The angle may range from 25 to 45 degrees, and may preferably be in a range from 30 to 40 degrees. At angles greater than 45 degrees, constraint 230 may not be significantly advantageous.

This mechanical locking feature may also prevent jamming the assembly while axially inserting the electronics carrier into the pressure barrel. Friction between the outer support ring and the pressure barrel could potentially push the outer support ring over the inner support ring, making the assembly more difficult or impossible. The internal upset 232, captured in a groove 234 in a circumferential outer surface of the electronics carrier blocks such problematic relative axial movement of the outer support ring. The same benefit may be achieved by an upset of the electronics carrier, engaging an internal groove in the inner diameter of the outer support ring.

The device 200 also features a constraint 256 restricting axial movement of the inner support ring 216 with respect to the electronics carrier 204. Constraint 256 may include upsets 254*a* and 254*b* (collectively 254) on the inner support ring. Upset 254*a* is configured to engage a groove 252*a* in an outer surface of the electronics carrier. Upset 254*b* is configured to engage a groove 252*b* in an outer surface of the electronics carrier. Grooves 252*a* and 252*b* are defined by a ledge 250 comprising a circumferential dovetail 258. Constraint 256 may enable pre-tensioning of the spring (biasing member 222), and thereby support a high load within a small area (e.g., inside a threaded connection). Also, without the upset, a spring-type biasing member may push the internal support ring too far towards the outer support ring. The outer support ring would then be expanded too much, making insertion of the electronics carrier into the pressure barrel more difficult or impossible. The half-dovetail shape of the ledge, particularly as engaged with a half-dovetail on the upset for the inner support ring, helps to keep the inner support ring in position until it is fully inserted into the pressure barrel.

Figure 2D:
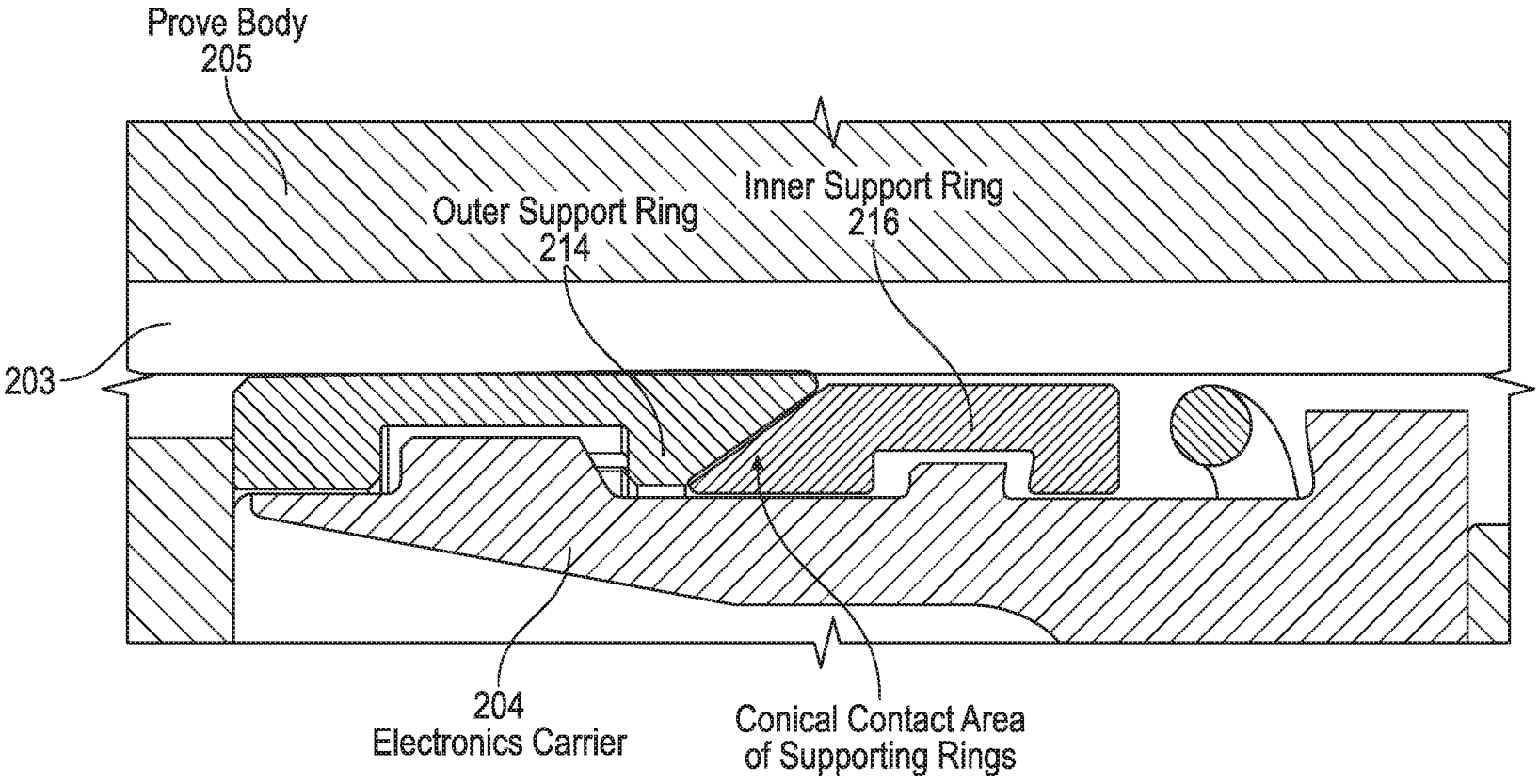

FIG. 2D shows device 201 from a cross sectional view. The biasing member 222 is configured to urge an intervening member 203 of the plurality of members against an inner surface 224 of a probe body 205 by urging the outer surface 228 of the inner support ring 216 against the inner surface 231 of the outer support ring 214, and thereby maintaining separation of the pressure barrel 202 and the electronics carrier 204. Intervening member 203 may be a slotted sleeve or the like configured to slide along the inner circumference of the probe body 205 unless urged into a compressional fit by outer support ring 214. Any number of intervening members of a variety of types may be used.

In some examples, the intervening member(s) additionally or alternatively may be located between the electronics carrier 204 and the inner support ring 216. Any of inner support ring 216, the outer support ring 214, intervening member(s) 203, probe body 205, and biasing member 222 may have protuberances, grooves, cavities, openings, and/or slots in accordance with particular contexts to achieve desired functionality with respect to that context.

Figure 3:
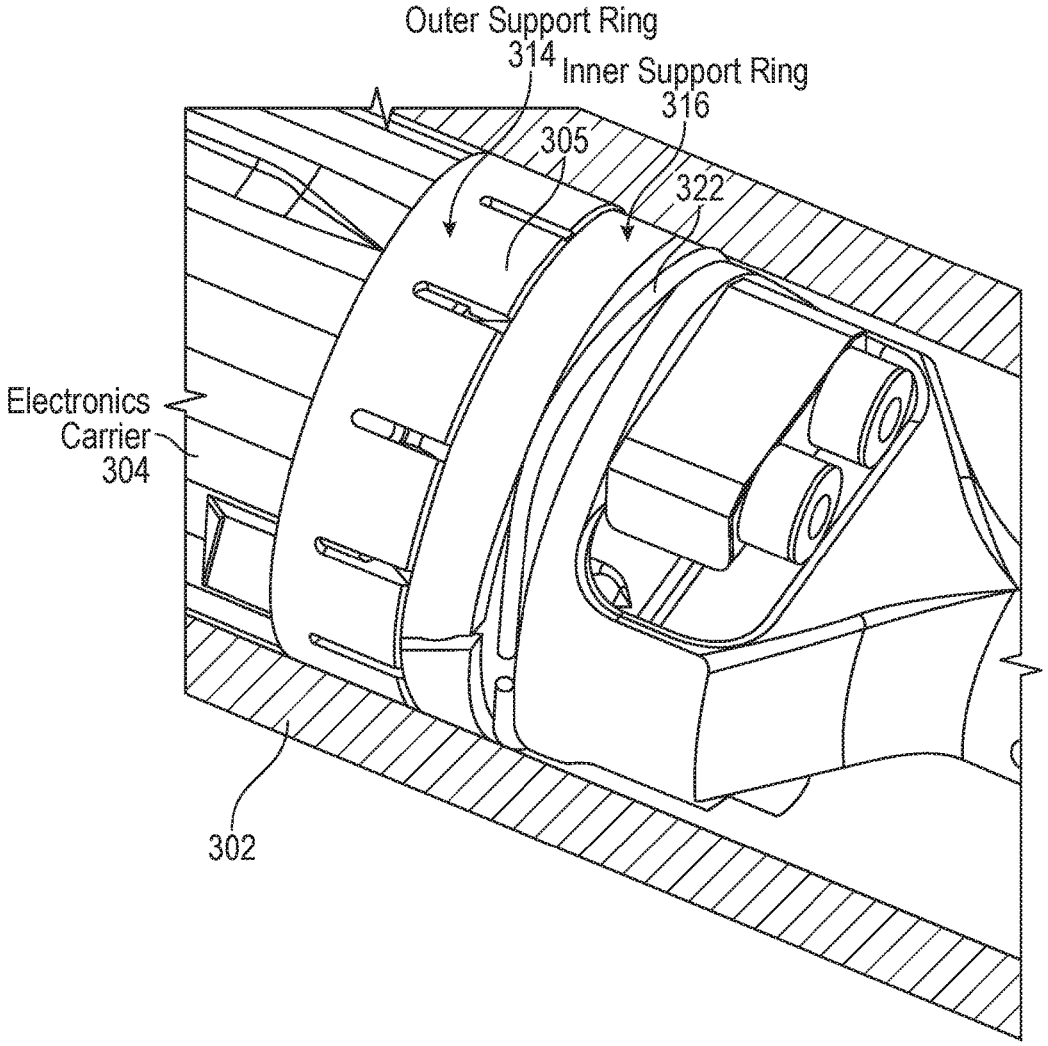
FIG. 3 is a cutaway illustration showing a device in accordance with embodiments of the present disclosure.

FIG. 3 is a cutaway illustration showing a device 300 in accordance with embodiments of the present disclosure. Device 300 comprises inner support ring 316, outer support ring 314, and biasing member 322. Inner support ring 316 and biasing member 322 are transversely severed to form split rings. The split ring facilitates ring diameter decrease upon urging the outer surface of the inner support ring 316 against the inner surface of the outer support ring 314, and allows the biasing member to be slipped over an end assembly prior to insertion in an outer tool body. Outer support ring 314 is transversely slotted on one edge to form fingers 305, which may be more easily flexed radially outward upon being urged by the outer surface of the inner support ring 316. Outer support ring 314 may, in other embodiments be transversely severed, or inner support ring may be slotted.

Figure 4A:
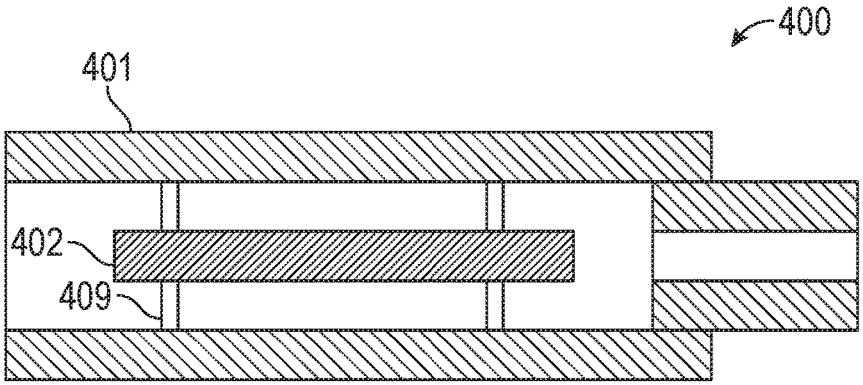
FIGS. 4A & 4B show cross-sectional views along the longitudinal axis illustrating devices in accordance with embodiments of the disclosure.
Figure 4B:
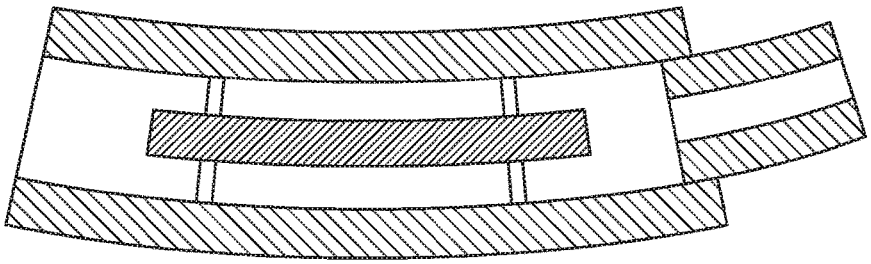

FIGS. 4A & 4B show cross-sectional views along the longitudinal axis illustrating devices in accordance with embodiments of the disclosure. Devices of the present disclosure show improved resistance to a bending moment placed on the tool in the borehole. FIG. 4A shows the tool in a straight hole. FIG. 4B shows the tool in a curved hole. As the tool 400 travels through a curved hole, a bending moment is applied on the tool by the formation. The pressure barrel 402 is mounted in the drill collar 401 by probe retention members 409. The pressure barrel may be configured to bend to a lesser extent than the drill collar.

Additionally, the lateral support system inside the pressure barrel may be configured to allow longitudinal travel of the carrier with respect to the pressure barrel to alleviate a bending force acting on the pressure barrel through deformation of the outer member caused by the shape of the surrounding borehole.

The term "conveyance device" as used above means any device, device component, combination of devices, media and/or member that may be used to convey, house, support or otherwise facilitate the use of another device, device component, combination of devices, media and/or member. Exemplary non-limiting conveyance devices include drill strings of the coiled tube type, of the jointed pipe type and any combination or portion thereof. Other conveyance device examples include casing pipes, wirelines, wire line sondes, slickline sondes, drop shots, downhole subs, BHA's, drill string inserts, modules, internal housings and substrate portions thereof, self-propelled tractors. As used above, the term "sub" refers to any structure that is configured to partially enclose, completely enclose, house, or support a device. The term "information" as used above includes any form of information (Analog, digital, EM, printed, etc.). The term "processor" or "information processing device" herein includes, but is not limited to, any device that transmits, receives, manipulates, converts, calculates, modulates, transposes, carries, stores or otherwise utilizes information. An information processing device may include a microprocessor, resident memory, and peripherals for executing programmed instructions. The processor may execute instructions stored in computer memory accessible to the processor, or may employ logic implemented as field-programmable gate arrays ('FPGAs'), application-specific integrated circuits ('ASICs'), other combinatorial or sequential logic hardware, and so on. Thus, configuration of the processor may include operative connection with resident memory and peripherals for executing programmed instructions.

Method embodiments may include conducting further operations in the earth formation in dependence upon the formation resistivity information, the logs, estimated parameters, or upon models created using ones of these. Further operations may include at least one of: i) extending the borehole; ii) drilling additional boreholes in the formation; iii) performing additional measurements on the formation; iv) estimating additional parameters of the formation; v) installing equipment in the borehole; vi) evaluating the formation; vii) optimizing present or future development in the formation or in a similar formation; viii) optimizing present or future exploration in the formation or in a similar formation; ix) evaluating the formation; and x) producing one or more hydrocarbons from the formation.

As used herein, the term "fluid" and "fluids" refers to one or more gasses, one or more liquids, and mixtures thereof. A "downhole fluid" as used herein includes any gas, liquid, flowable solid and other materials having a fluid property and relating to hydrocarbon recovery. A downhole fluid may be natural or man-made and may be transported downhole or may be recovered from a downhole location. Non-limiting examples of downhole fluids include drilling fluids, return fluids, formation fluids, production fluids containing one or more hydrocarbons, engineered fluids, oils and solvents used in conjunction with downhole tools, water, brine, and combinations thereof.

The term "ring," as used herein refers to any substantially circular band. Rings as described herein may be split or slotted, or may be uninterrupted. Receiving, as used herein, refers to radial envelopment, with or without physical contact. A circuit element is an element that has a non-negligible effect on a circuit in addition to completion of the circuit. By "electronics carrier," it is meant the innermost structural housing surrounding one or more electronic components.

While the foregoing disclosure is directed to the one mode embodiments of the disclosure, various modifications will be apparent to those skilled in the art. It is intended that all variations be embraced by the foregoing disclosure.

What is claimed is:

1. An apparatus for use in a borehole intersecting an earth formation, the apparatus comprising:

a downhole tool comprising an outer member configured for conveyance in the borehole;

a probe body positioned inside the outer member;

an electronics carrier positioned inside the probe body; and a lateral support system comprising:

a plurality of members cooperating to maintain a relative position of the electronics carrier with respect to the probe body, the plurality of members comprising:

an outer support ring within the probe body having an axial passage therethrough for receiving a portion of the electronics carrier, the outer support ring having an inner surface;

an inner support ring within the probe body having an axial passage therethrough for receiving a second portion of the electronics carrier, the inner support ring having an outer surface; and a biasing member configured to urge a member of the plurality of members against an inner surface of the probe body by urging the outer surface of the inner support ring against the inner surface of the outer support ring, and thereby maintaining separation of the probe body and the electronics carrier.

2. The apparatus of claim 1, wherein the outer surface of the inner support ring comprises a frustoconical section.

3. The apparatus of claim 1, wherein the inner surface comprises an angled seat for receiving the inner support ring such that the outer support ring deforms upon receiving the inner support ring at the seat.

4. The apparatus of claim 1, wherein the member urged against the inner surface of the probe body is the outer support ring.

5. The apparatus of claim 1, wherein at least one of the outer support ring and the inner support ring is made up of a polyaryletherketone material.

6. The apparatus of claim 1, wherein at least one of the inner support ring and the outer support ring comprises at least one slot.

7. The apparatus of claim 1, further comprising a constraint restricting axial movement of the outer support ring with respect to the electronics carrier without restricting the axial movement of the outer support ring with respect to the probe body.

8. The apparatus of claim 7, wherein the constraint comprises at least one of:

i) an upset on the outer support ring configured to engage a groove in an outer surface of the electronics carrier, and ii) a band on the outer surface of the electronics carrier configured to engage a groove in the outer support ring.

9. The apparatus of claim 1, wherein the biasing member is made of metal.

10. The apparatus of claim 9, wherein the metal is non-magnetic.

11. The apparatus of claim 1, wherein the biasing member is confined to an annular space defined by the probe body and the electronics carrier by a shoulder.

12. The apparatus of claim 11, wherein the shoulder comprises a circumferential dovetail on the electronics carrier.

13. The apparatus of claim 1, further comprising a constraint restricting axial movement of the inner support ring with respect to the electronics carrier.

14. The apparatus of claim 13, wherein the constraint comprises an upset on the inner support ring configured to engage a groove in an outer surface of the electronics carrier, wherein the groove is defined by a ledge comprising a circumferential dovetail.

15. The apparatus of claim 1, wherein the probe body comprises a pressure barrel.

* * * * *